US007219806B1

(12) United States Patent
Morrow

(10) Patent No.: US 7,219,806 B1
(45) Date of Patent: May 22, 2007

(54) PRODUCT DISPLAY APPARATUS

(75) Inventor: Lester Morrow, Chanhassen, MN (US)

(73) Assignee: In-Store Systems, LLC, Chanhassen, MN (US)

( * ) Notice: Subject to any disclaimer, the term of this patent is extended or adjusted under 35 U.S.C. 154(b) by 134 days.

(21) Appl. No.: 11/080,589

(22) Filed: Mar. 15, 2005

Related U.S. Application Data

(60) Provisional application No. 60/553,085, filed on Mar. 15, 2004.

(51) Int. Cl.
*A47F 5/08* (2006.01)

(52) U.S. Cl. ..... 211/59.1

(58) Field of Classification Search ..... 211/59.1, 211/54.1, 57.1, 7; 248/220.41, 220.31, 221.11; 70/62

See application file for complete search history.

(56) References Cited

U.S. PATENT DOCUMENTS 5,441,161 A * 8/1995 Merl ..... 211/57.1
6,003,685 A * 12/1999 Malin ..... 211/7
6,131,748 A * 10/2000 Kawasaki et al. ..... 211/54.1
6,877,616 B2 * 4/2005 Plutsky ..... 211/43

* cited by examiner

*Primary Examiner*—Sarah Purol
(74) *Attorney, Agent, or Firm*—Haugen Law Firm PLLP

(57) ABSTRACT

The present invention provides a product display apparatus having a mounting member with a guide device extending outwardly therefrom in a substantially horizontal orientation. A product support member is suspended from the guide device and is slidably coupled to the guide device. In the first orientation the product support member is extended outwardly from the guide device for loading product thereon. In a second orientation the product support member is retracted to a product display orientation.

21 Claims, 5 Drawing Sheets

12
24
14
16
26
10
20
32
38
28
36
58
50
44
46
30
34
48
62
54
52
42
40
56
60
64

12
24
28
22
28
20
32

58
46
44
50
48
54
52

PRODUCT DISPLAY APPARATUS

CROSS REFERENCE TO RELATED APPLICATIONS

This application claims priority from U.S. provisional patent application Ser. No. 60/553,085 filed on Mar. 15, 2004 and entitled "Pull-out Merchandising Hook", the content of which is herein incorporated by reference in its entirety.

FIELD OF THE INVENTION

The present invention relates generally to the field of product display systems. More particularly, the present invention relates to a retail display system for displaying a number of hanging products and/or packages.

BACKGROUND OF THE INVENTION

The present retail environment utilizes a number of display systems for storing and displaying different products. One common method is the use of a display hook. Such display hooks require a mounting member for mounting the display hook to a peg board or display bar such that the display hook extends substantially horizontally from the mounting member. Products are packaged or configured to have a hanging hook or a punctured hole in them to allow a number of products to be displayed from a single display hook. A purchaser may then slide the foremost product from a hook such that the following product will then be displayed on the hook.

A problem with such prior art display devices occurs where products may have a short shelf life, such as in the case of perishable items such as food products. Such products often contain an expiration date before which the product must be sold. It is therefore preferable that the product with the earliest expiration date or the product that has been on display the longest be sold first to ensure freshness. Such sales preference is commonly referred to as a first in, first out (FIFO) inventory process, such that the freshness of goods and products are maximized. In order to achieve this, the first in product, or oldest product, is put at the front section of the product display so that it is most easily accessible to consumers. The newest product, therefore, must be loaded at the back of the product display where it is less accessible. This is a burden to retailers because traditionally all product in the front section must be removed to refill the back section of the shelf with the newest product while keeping the oldest products in front. Even with packaging that has a hook-like hanger for easy placement at any position on a product displaying hook, it is difficult to access the back of the display because adjacent products tend to block access thereto. Thus, the front most product must still be removed from the peg hook in order to put the newest product in the back section and the oldest product in the front section.

An object of the present invention is to provide a system for easy product placement on a product display device without requiring the front product to be removed there from.

SUMMARY OF THE INVENTION

The present invention provides a product display apparatus comprising a mounting member for securing the apparatus to a peg board wall or, alternatively, to a display bar for display in a retail environment. A support member extends outwardly and substantially horizontally from the mounting member. A product display device is slidably coupled to the support member by a slidable engagement mechanism. The product display device is able to extend outwardly with respect to the support member to allow easy access to the rear section of the product display hook. New products may then be easily placed in the rear section, leaving existing products in the front portion of the product display device. The product display device may then be slidably returned to the display orientation and locked in place by a locking mechanism that secures the mounting member to the slidable engagement mechanism.

In another embodiment, a transverse member extends between the slidable engagement mechanism of more than one product display apparatus such that any number of additional product display devices may be coupled to the transverse member, allowing a number of product display devices to be simultaneously slidably extended for loading of new product and slidably returned to a display configuration.

In yet another embodiment, a product display apparatus provides a support member with a display basket slidably suspended from a corresponding slidable engagement mechanisms.

DETAILED DESCRIPTION OF THE PREFERRED EMBODIMENTS

Figure 1:
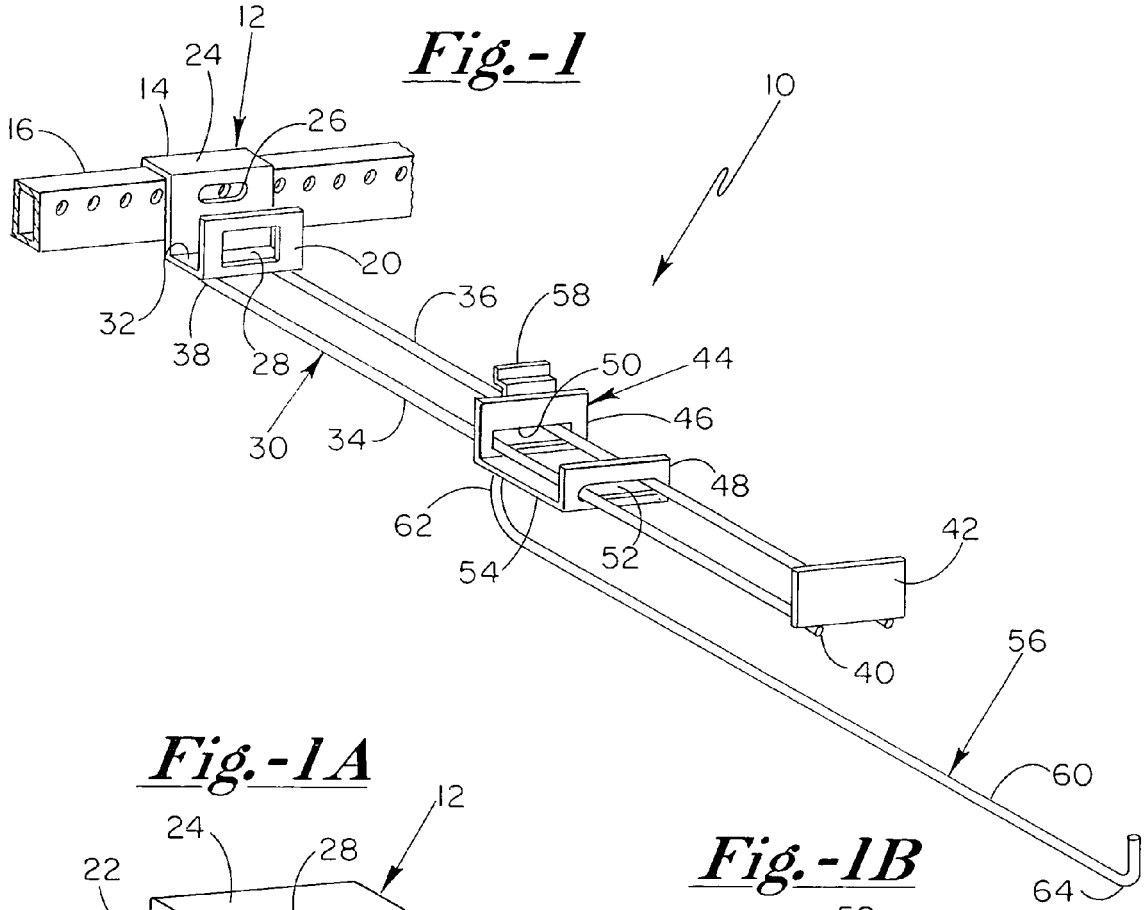
FIG. 1 is a perspective view of a first embodiment of the present invention.

FIG. 1 shows a first embodiment of a product display apparatus 10 in accordance with the present invention. A mounting member 12 is shown having a mounting portion 14 for use with a bar display assembly 16.

Figure 1A:
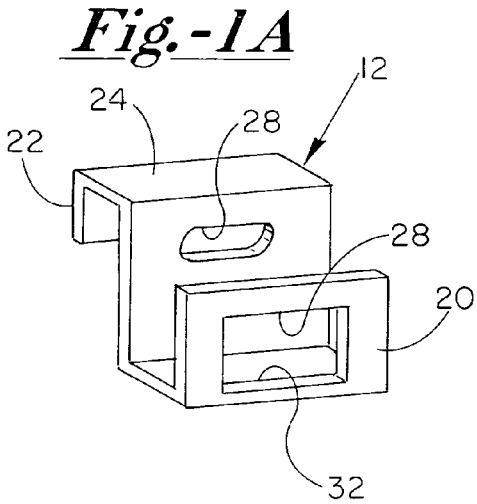
FIG. 1A is a magnified view of the mounting member from FIG. 1.

As shown in more detail in FIG. 1A, the mounting portion 14 has a front brace 20 and back brace 22 connected to each other by a top brace 24 that is configured to extend over the bar display 16. Mounting portion 14 may include one or more apertures 26 in front brace 20 for optionally receiving a positioning device (not shown) therethrough and into respective apertures in bar display 16 for positioning product display apparatus 10 in a secured location along bar display 16. The mounting portion, alternatively, may be configured to mount on a peg board display assembly or any other mounting portion common to a retail display apparatus.

A guide device 30 operably extends substantially horizontally from mounting member 12 in a direction substantially perpendicular to bar display 16. In some embodiments, guide device 30 extends from a support floor 32 of the mounting member 12. The guide device 30 may preferably comprise a pair of parallel extension arms 34, 36 that extend from a first, proximal end 38 of guide device 30 to a second, distal end 40, thereof. As shown, the second end 40 of the guide device 30 may further include an information panel 42 disposed thereat on which to provide pricing and product information.

Figure 1B:
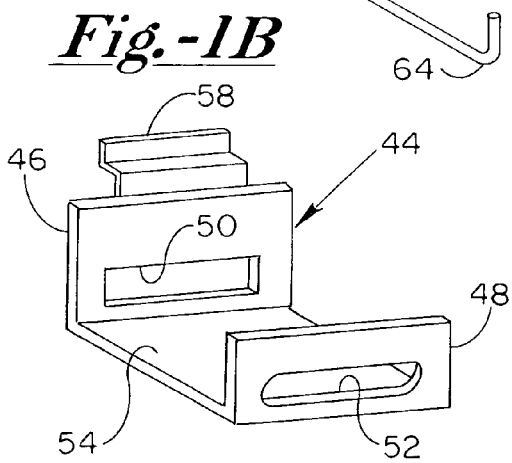
FIG. 1B is a magnified view of the slidable engagement mechanism from FIG. 1.

As shown in FIG. 1 and in more detail in FIG. 1B, a slidable engagement mechanism 44 is slidably coupled to the guide device 30. The slidable engagement mechanism 44 comprises a first and second upright structures 46, 48, respectively, each having an aperture 50, 52 for slidably receiving the guide device 30 therethrough, and a base structure 54 extending between and couples together first and second upright structures 46, 48. In some embodiments the first upright structure 46 may have a hooked portion 58 that may operably engage with an aperture 28 of mounting member 12 for removably securing slidable engagement mechanism 44 to mounting member 12. Such an engagement is accomplished by slightly angling the slidable engagement mechanism 44 to allow the hooked portion 58 to extend into aperture 28.

Other embodiments of a slidable engagement mechanism are contemplated for use with the present invention that carry a similar function to achieve similar results as illustrated in more detail with reference to FIGS. 2 and 3.

Product support member 56 is preferably suspended from, slidable engagement mechanism 44 and is therefore coupled to guide device 30. The product support member 56 is defined by a substantially horizontally extending elongated product hook 60 which extends in a substantially parallel relationship to the guide device 30. A first, proximal end 62 may be curved or angled to connect to slidable engagement mechanism 44. The second, distal end 64 of the product support member 56 may also have an upward hook 66 to maintain products thereon and prevent products from being unintentionally removed from the product support member 56.

Figure 5:
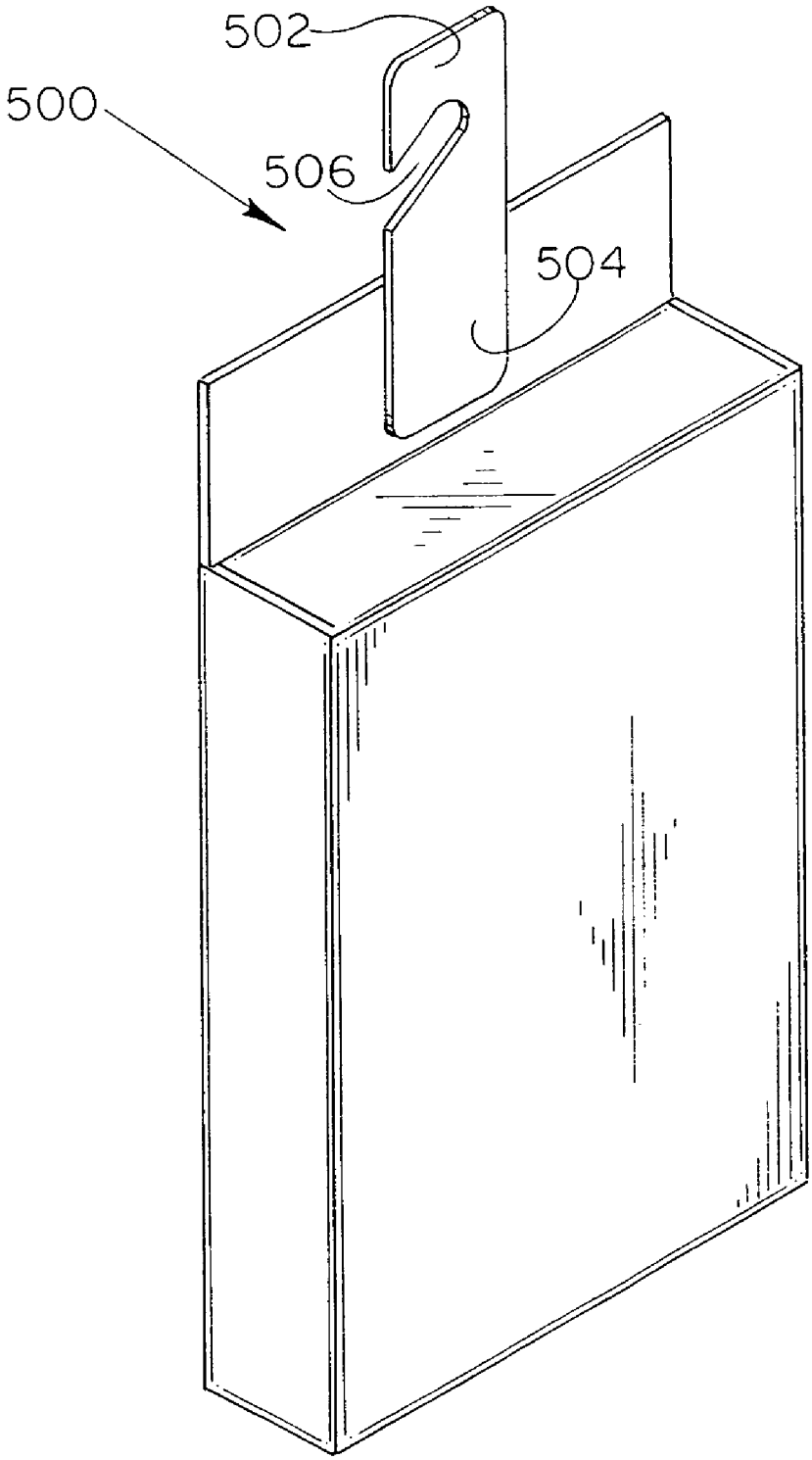
FIG. 5 is an embodiment of a product for use with the present invention.

FIG. 5 shows a product 500 for use with the present invention. The product 500 packaging includes a hook portion 502 for hanging the product 500 on the product support member 56. The hook 502 may be stamped into the product packaging, such as at an upper portion of the product 500, or may be a separate component 504 that is secured to the product 500 (as shown in FIG. 5). The hook 502 may define a slot 506 which may be angled or j-shaped or any other configuration that allows the product to be displayed from the product support member 56 by sliding hook 502 over the product support member 56 such that the product support member 56 is received within the slot 506.

In use, the product support member 56 may be movably manipulated in conjunction with slidable engagement mechanism 44 to a fully extended orientation where product 500 may then be easily loaded or unloaded from the product support member 56. In such configuration, a user is easily able to add fresh product adjacent to the proximal end 62 of the product support member 56 and leave existing product adjacent to distal end 64 of the product support member 56. Once product 500 has been placed on the product support member 56 as desired the product support member 56 may be moved to a display orientation adjacent the bar display assembly 16, such that the slidable engagement mechanism 44 may be engaged with the mounting member 12. Consumers are then likely to access product at the front portion 64 of the product display apparatus 10.

Figure 2:
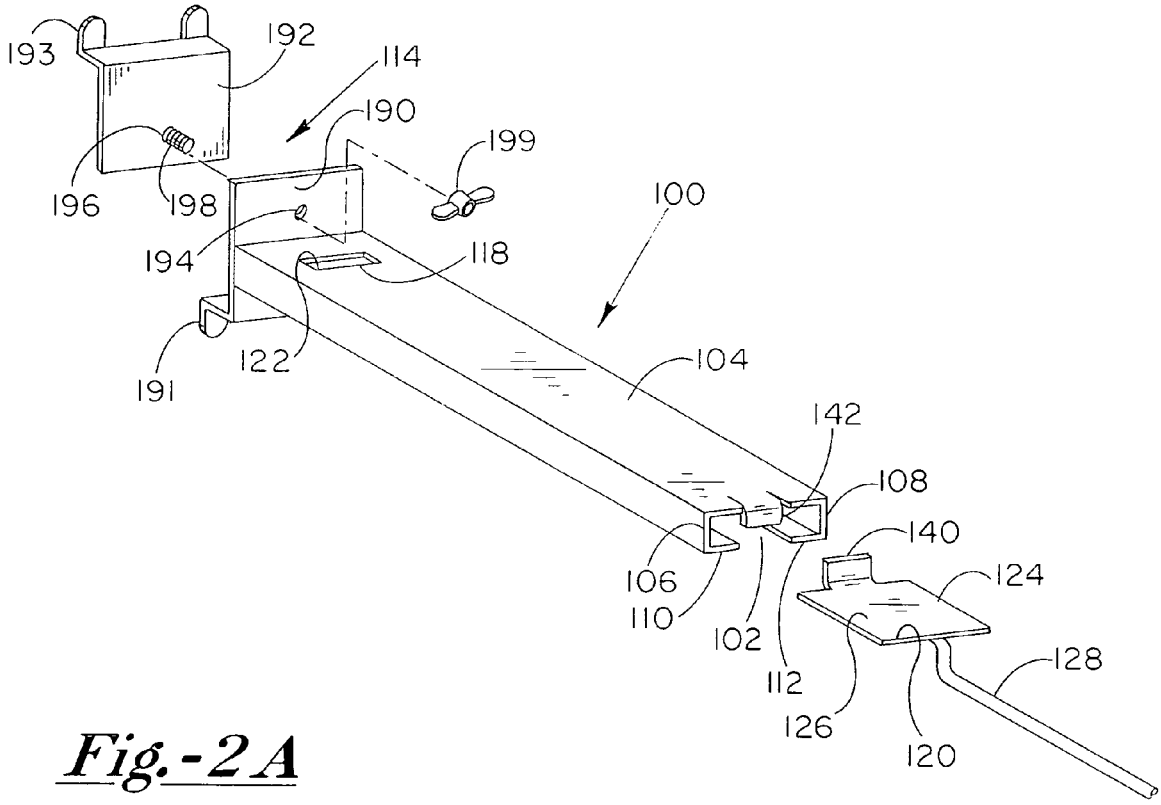
FIG. 2 is a perspective view of a second embodiment of the present invention.

FIG. 2 shows another embodiment of the present invention wherein the guide device 100 may be a single member having a top panel 104 and a pair of opposing side panels 106, 108 with guide arms 110, 112 extending inwardly from respective lower edges 107, 109 of side panels 106, 108 so as to define collectively channel 102 therebetween.

The guide device 100 operably extends substantially horizontally from the mounting member 114, shown in more detail in FIG. 2B. The mounting member 114 has a first mounting plate 190 and a second mounting plate 192 each having a respective aperture 194, 196 which, when mounted, are in axial alignment with each other. Each mounting plate 190, 192 additionally has one or more mounting hooks 191, 193 which allow the mounting plates 190, 192 to attach to a peg board (not shown) by tilting the mounting hooks 191, 193 into corresponding receiving hooks (not shown) on a peg board. The mounting member 114 is secured to a peg board such as by receiving a positioning device 198 through the apertures 194, 196 and through a correspondingly aligned aperture of a peg board (not shown). A locking member 199, shown as a wing nut in FIG. 2B, is used to lock the mounting member 114 to the peg board and provide support thereto. The mounting member 114 may be alternatively configured to mount to a display bar as shown and as discussed with reference to FIG. 1 or any other suitable mounting configuration.

The slidable engagement mechanism 120 is configured to be suspended from the guide device 100. In this embodiment, the slidable engagement mechanism 120 preferably has a pair of extensions 124, 126 that are slidably received within the channel 102 in juxtaposition with guide arms 110, 112, such that the extensions 124, 126 are maintained in a slidably coupled relationship with guide arms 110, 112. The slidable engagement mechanism 120 slidably couples the product support member 128 to the guide member 100. The product support member 128 is preferably an elongated hook and, once again, extends substantially parallel to the guide member 100 and may be slidably extended outwardly for loading of product thereon, and may be slidably extended inwardly for display to consumers.

The guide member 100 further includes a hook portion 140 that operably extends vertically with respect to the horizontally extending extensions 124, 126.

Figure 2A:
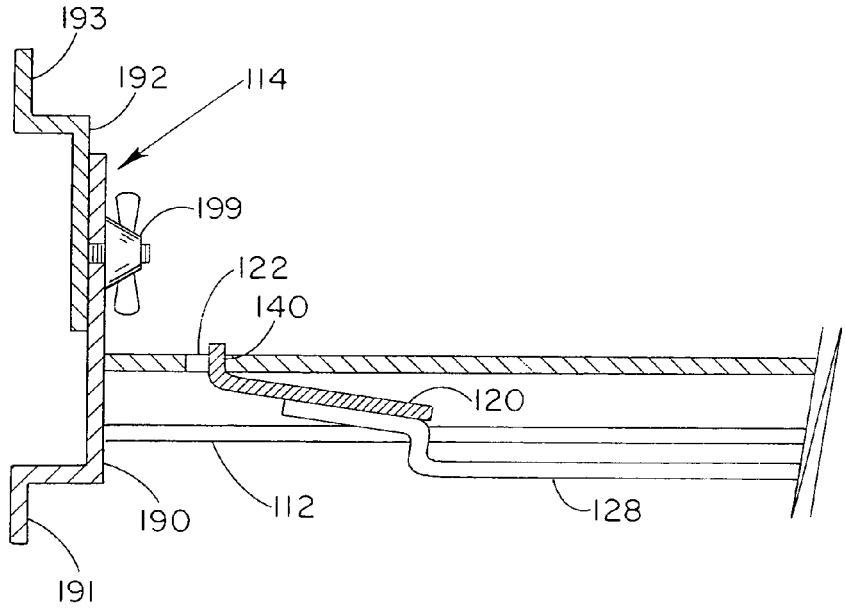
FIG. 2A is a cut-away view of the locking mechanism from the embodiment from FIG. 2.

As shown in more detail with respect to FIG. 2A, the proximal, first end 116 of the channel 102 may include a locking mechanism 118 for locking the slidable engagement mechanism 120 thereto when the product display apparatus 10' is oriented for display to consumers. In the present embodiment, the locking mechanism 118 may be a detent 122 in the top panel 104, which detent 122 is defined by an aperture in the present embodiment. The detent 122 is configured to operably receive the hook portion 140 of the slidable engagement mechanism 120 in order to lock the slidable engagement mechanism 120 in a display orientation with respect to the guide member 100. The slidable engagement mechanism 120 may be disengaged from the locking mechanism 118 by angling the product support member 128 upwardly causing the hook portion 140 to be pivotably removed from the locking mechanism 118. The slidable engagement mechanism 118 is then able to slide within the channel 102 of the guide member 110.

Returning now to FIG. 2, the distal, second end 119 of the channel 102 has a downwardly extending hook portion 142 which acts as a second locking mechanism 144. The downwardly extending hook portion 142 provides a positive stop by engaging the hook portion 140 of the slidable engagement mechanism 118 and preventing the slidable engagement mechanism 118 from sliding beyond the distal end 119 of the channel 102.

Figure 3:
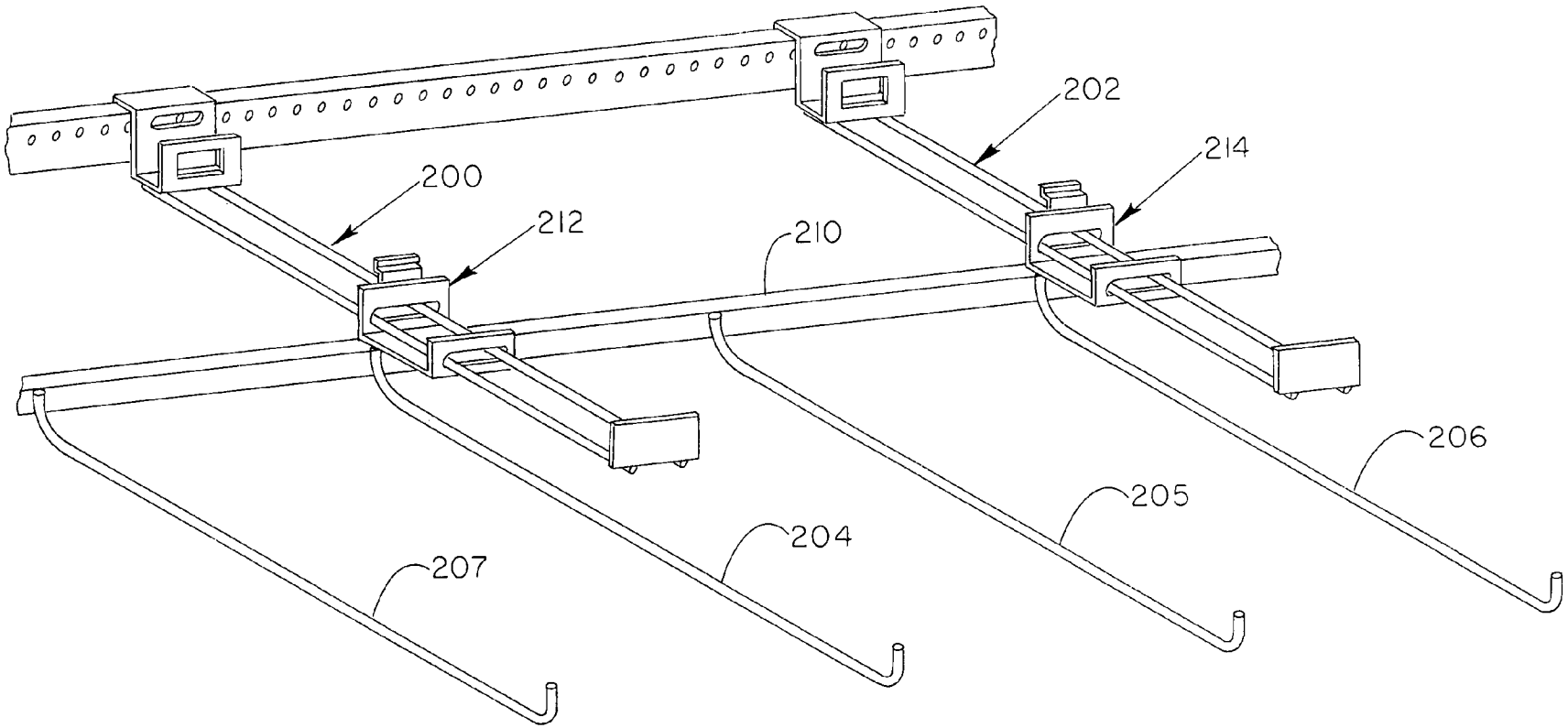
FIG. 3 is a third embodiment of the present invention.

FIG. 3 shows a third embodiment of the present invention wherein a plurality of guide devices 200, 202 allow a plurality of interconnected product support members 204, 205 206, 207 to be extended simultaneously. A transverse member 210 extends at least from a first guide device 200 to a second guide device 202. The transverse member 210 is preferably coupled to the respective slidable engagement mechanisms 212, 214 of each of the first and second guide devices 200, 202 such that any number of additional product support members may also extend outwardly from the transverse member 210. As shown, two additional product support members 205, 207 extend from the transverse member 210, as supported from the guide devices 200, 202.

Figure 4:
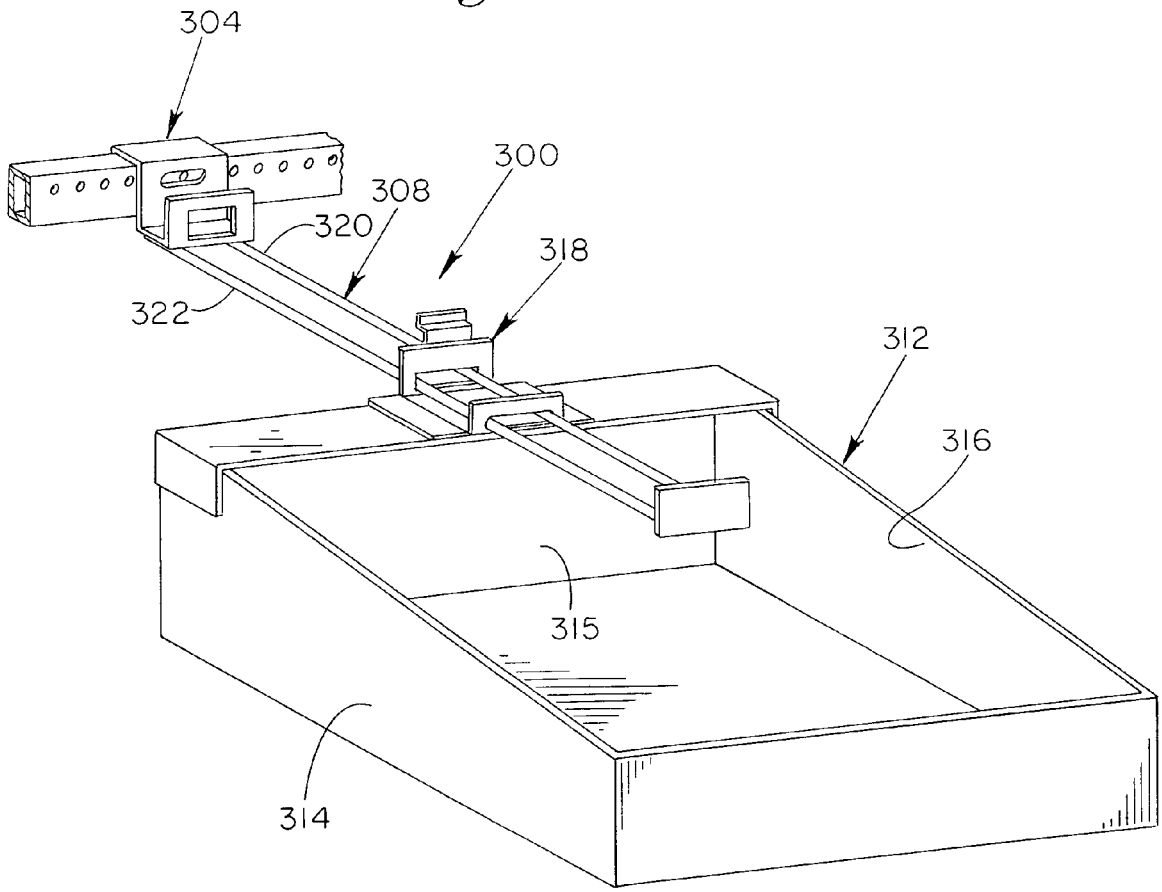
FIG. 4 is a fourth embodiment of the present invention.

FIG. 4 shows yet another embodiment of the present invention. A product support mechanism 300 is shown, having a mounting member 304 and a guide device 308. A basket 312 having opposing side panels 314, 316 and a back panel 315 is slidably coupled to the guide device 308 by a slidable coupling mechanisms 318 that allow the basket 312 to slidably extend outwardly from the guide members 308 for loading of new product, and to slidably return to a display configuration wherein the basket is reversibly locked in position such that the back panel 315 of the basket 312 is adjacent the mounting member 304.

As illustrated in FIG. 4, it is contemplated within the scope of the present invention that any other suitable product support members may be used in place of or in addition to the elongated product hooks. It is further contemplated that the basket 312 could act as the transverse member 210 shown in reference to FIG. 3 such that the pair of guide devices 200, 202 could be used to support the basket 312.

It is understood that the embodiments of the present invention are illustrative of the present invention and not intended to be limiting. For example, it is contemplated that the various product support members disclosed herein or falling within the scope and spirit of the present invention may be coupled to any number of guide devices disclosed herein or falling within the scope and spirit of the present invention.

What is claimed is:

1. A product display apparatus comprising:

a) a mounting member for operatively mounting said product display apparatus on a support structure;

b) a guide member extending substantially horizontally from said mounting member;

c) a product support member at which one or more product packages are operably removably secured, said product support member being suspended from said guide member and slidably coupled to said guide member via a slidable engagement means.

2. The product display apparatus in accordance with claim 1 wherein said product support member is an elongated rod.

3. The product display apparatus in accordance with claim 2 wherein said guide member comprises a pair of elongate arms.

4. The product display apparatus in accordance with claim 3 wherein each of said elongate arms have a locking means for engaging said slidable engagement means.

5. The product display apparatus in accordance with claim 4 wherein said locking means is a detent.

6. The product display apparatus in accordance with claim 2 wherein said guide member defines a channel for guiding said slidable engagement means.

7. The product display apparatus in accordance with claim 6 wherein said guide member has a locking means.

8. The product display apparatus in accordance with claim 7 wherein said locking means is a detent in said channel.

9. The product display apparatus in accordance with claim 1 wherein a display member is positioned at an accessible end of said guide member.

10. The product display apparatus in accordance with claim 9 wherein said mounting member is mounted to a peg board.

11. The product display apparatus in accordance with claim 10 wherein said mounting member is mounted to a display bar.

12. A pull out merchandising system comprising:

a) a first product support member and a second product support member, each of said product support members being suspended from and slidably engaged to a corresponding guide member;

b) a transverse member extending between and connecting to said first product support member and said second product support member.

13. The pull out merchandising system in accordance with claim 12 wherein a supplemental product support member is connected to said transverse member in a substantially parallel relationship to said first product support member and said second product support member.

14. The pull out merchandising system in accordance with claim 12 wherein a basket is suspended at opposing sides by said first product support member and said second product support member, respectively.

15. A product display apparatus, comprising:

(a) a guide member having a mounting portion and a guide portion, said mounting portion being operably securable to a support structure in an orientation such that said guide portion extends substantially outwardly from said support structure; and (b) a product support member at which one or more product packages are operably removably secured, said product support member being slidably suspended from said guide portion of said guide member.

16. A product display apparatus as in claim 15, including an engagement mechanism coupled to said product support member.

17. A product display apparatus as in claim 16 wherein said engagement mechanism is slidably engaged with said guide portion.

18. A product display apparatus as in claim 15 wherein said guide portion is a channel formed in said guide member.

19. A product display apparatus as in claim 18 wherein said channel opens downwardly.

20. A product display apparatus as in claim 15 wherein the support structure is a peg bar.

21. A method for displaying a packaged product, said method comprising:

(a) providing a product display apparatus having:

(i) a guide member having a mounting portion and a guide portion, said mounting portion being operably securable to a support structure in an orientation such that said guide portion extends outwardly from said support structure;

(ii) a product support member slidably suspended from said guide portion of said guide member; and (b) removably securing said packaged product at said product support member.

* * * * *